United States Patent [19]

Takahashi et al.

[11] Patent Number: 4,810,226

[45] Date of Patent: Mar. 7, 1989

[54] CALLING DEVICE OF MOTION TOY AND MOTION TOY USING SAID CALLING DEVICE

[75] Inventors: Hajime Takahashi, Tokyo; Masahiro Toda, Saitama, both of Japan

[73] Assignee: Iwaya Corporation, Tokyo, Japan

[21] Appl. No.: 134,821

[22] Filed: Dec. 18, 1987

[30] Foreign Application Priority Data

Jun. 9, 1987 [JP] Japan ..... 62-143822

[51] Int. Cl.[4] ..... A63H 3/28; A63H 11/20

[52] U.S. Cl. ..... 446/300; 446/356; 446/420

[58] Field of Search ..... 446/300, 298, 301, 297, 446/303, 420, 397, 418, 404, 356, 337; 116/144

[56] References Cited

U.S. PATENT DOCUMENTS 2,940,755 6/1960 Pouder ..... 446/297 X 2,953,869 9/1960 Collischan ..... 446/300 X

FOREIGN PATENT DOCUMENTS 879993 10/1961 United Kingdom ..... 446/301

*Primary Examiner*—Mickey Yu

*Attorney, Agent, or Firm*—James E. Nilles

[57] ABSTRACT

A calling device and a motion toy for using the calling device are disclosed. The motion toy comprises a body frame having a machine frame inside thereof. Foreleg frames, hind leg frames, and a tail frame are rotataly mounted on the body frame. A nose frame is mounted for back and forth movement on the main frame. A first driving gear is rotatably mounted in the machine frame to actuate the foreleg and hind leg frames. A second driving gear is rotatably mounted in the machine frame to actuate the tail and nose frames. A changeover gear is mounted on the machine for rotation about an axis and sliding movement along the axis for alternate engagement with either the first or the second driving gear. A motor is operatively connected to drive the changeover gear. The calling device of the motion toy includes a calling gear having teeth thereon rotatably mounted on the machine frame. A resonance box is mounted on the machine frame and has a resonance lead presenting an oscillation portion in facing relation to the calling gear. A rocking arm is rotatably mounted on the machine frame and has a support plate engageable with the resonance lead and a cam follower. A cam is rotatably mounted on the machine frame for contact with the cam follower so that rotation of the cam will cause the cam follower to rotate the rocking arm back and forth to move the support plate into engagement with and disengagement from the oscillating portion of the resonance lead to cause it to intermittently contact the teeth on the calling gear.

4 Claims, 5 Drawing Sheets

CALLING DEVICE OF MOTION TOY AND MOTION TOY USING SAID CALLING DEVICE

BACKGROUND OF THE INVENTION

1. Field of the Invention

This invention relates to a calling device of a motion toy and a motion toy using the calling device More particularly, the present invention relates to a motion toy which generates an imitation call of a desired animal and exhibits motion in response to the call.

2. Description of the Prior Art

Calling devices of motion toys imitating animals are disclosed, for example, in Japanese Utility Model Publication No. 24309/1986. According to this prior art reference, a bellows-like calling box is disposed in a machine frame, a push support rod of an elevation plate is meshed with one side of a contraction portion of this calling box and the contraction portion is caused to expand and contract by this push support rod. Another structure is described in Japanese Utility Model Publication No. 21104/1986, wherein a bellows-like calling member is disposed in a machine frame, a fitting rod of an oscillation member is anchored to a bellows-like contraction portion of the calling member and the contraction portion is operated by this oscillation member.

According to the structure of the bellows-like calling device, no sound will be generated if the contraction portion is expanded and contracted slowly. In other words, the contraction portion must be expanded contracted always extremely strongly and instantaneously. Even when the sound is generated, there is no room for the occurrence of a higher-pitched sound than the sound which is responsive to the exhaust power by the contraction of the contraction portion. Moreover, the generated sound is almost constant, has no variation and is likely to be monotonous.

SUMMARY OF THE INVENTION

It is therefore an object of the present invention to provide a calling device of a motion toy which can reliably generate a sound and can greatly change the sound thus generated.

It is another object of the present invention to provide a motion toy which uses the calling device described above and can perform predetermined motion in accordance with the sound generated from the calling device.

The calling device of a motion toy in accordance with the present invention comprises a machine frame; a calling gear fitted rotatably to the machine frame; a resonance box having a resonance lead equipped with an oscillation portion facing the calling gear on the machine frame; a rocking arm having a support plate and a rocking pin for pushing the resonance lead at the tip thereof, and disposed rotatably on the machine frame; and a cam disposed rotatably on the machine frame for rocking the rocking pin of the rocking arm and engaging and disengaging the oscillation portion of the resonance lead through the support plate with and from the teeth of the calling gear when the rocking pin of the rocking arm is rocked.

The motion toy in accordance with the present invention comprises a toy body having a machine frame disposed inside a body frame, right and left foreleg frames and hind leg frames disposed rotatably in the body frame, a nose frame disposed movably back and forth in the body frame and a tail frame disposed rotatably in a horizontal surface in the body frame; a first driving gear disposed rotatably in the machine frame of the toy body for rotating back and forth the right and left foreleg frames and hind leg frames through a crank shaft; a second driving gear disposed rotatably in the machine frame for operating the nose frame and the tail frame through a crank shaft; a calling gear disposed rotatably in the machine frame and rotated by the power from the second driving gear; a resonance box having a resonance lead equipped with an oscillation portion facing the calling gear disposed on the machine frame; a rocking arm disposed rotatably on the machine frame and having a support plate and a rocking pin for pushing the resonance lead at the tip hereof; a cam disposed rotatably on the machine frame, rotated by the power from the second driving gear for rocking the rocking pin of the rocking arm and engaging and disengaging the oscillation portion of the resonance lead through the support plate with and from the teeth of the calling gear when the rocking pin of the rocking arm is rocked; and a change-over gear disposed rotatably and removably on the machine frame and engaging alternately with the first and second driving gears in the interlocking arrangement therewith by the power from a motor.

In the calling device of the motion toy of the present invention, when the calling gear is rotated counterclockwise, for example, in FIG. 1 and a cam disk having a cam is rotated clockwise, for example, in FIG. 1, a rocking pin meshing with the cam is rocked in a vertical direction in accordance with the shape of the cam by the rotation of the cam disk and a rocking arm having this rocking pin is rocked in the vertical direction with a support shaft being the center. A support shaft is rocked up and down by the rocking operation of the rocking arm and a resonance lead engaged with the lower end portion of the support plate is moved up and down so that an oscillation portion of this resonance lead is sequentially and intermittently engaged with and disengaged from each tooth of the rotating calling gear in a predetermined amplitude. The lowering operation of the oscillation portion which is moved up and down and the sliding rotation with each tooth of the calling gear generates a sliding rotation sound of a predetermined amplitude and this sliding rotation sound is amplified and greatly resonated inside a resonance box through the resonance lead like the grunting sound of a pig, for example.

In the motion toy of the present invention, when a motor is actuated, a change-over gear is rotated and in turn rotates a first driving gear and a crank shaft. Right and left foreleg frames are rotated back and forth due to the rotation of crank arms at both ends of this crank shaft. The rotation of the right and left foreleg frames rotate right and left hind leg frames back and forth through right and left interlocking plates, respectively. Therefore, the toy body repeats its advancing operation by the rotation of the right and left foreleg frames and hind leg frames in the longitudinal direction for a predetermined period.

When switched, the change-over gear disengages from the first driving gear and meshes with the second driving gear in place of the first driving gear and rotates the latter. Then, while the toy body stops its advancing motion, its crank shaft is rotated by the rotation of the second driving gear and the rotation of its crank arm moves back and forth a nose frame so that the toy body twitches its nose and its tail frame is rotated back and forth in the horizontal surface as if the toy body drove away any horseflies or flies.

When the second driving gear is rotated as described above, the calling gear is rotated counterclockwise, for example, in FIG. 1 and the cam disk having the cam is rotated clockwise, for example, in FIG. 1.

Then, due to the rotation of the cam disk, the rocking pin meshing with this cam is rocked vertically in accordance with the shape of the cam and the rocking arm having this rocking pin is rocked vertically. is rocked vertically and the resonance lead meshing with the lower end of the support plate is moved up and down so that the oscillation portion of the resonance lead is sequentially and intermittently engaged with and disengaged from each tooth of the calling gear in a predetermined amplitude. Due to the lowering motion of the oscillation portion which is moved up and down and its sliding rotation with each tooth of the calling gear, a sliding rotation sound having a predetermined sound is generated, and is amplified and resonated greatly inside the resonance box through the resonance lead. Therefore, the toy body generates an imitation sound such as the grunting sound of a pig, for example.

As described above, the toy body stops its advancing motion, wags his tail, twitches its nose and generates the grunting sound repeatedly for a predetermined period.

The above and other objects and novel features of the present invention will become more apparent from the following description when taken in conjunction with the accompanying drawings.

DESCRIPTION OF THE PREFERRED EMBODIMENT

Figure 3:
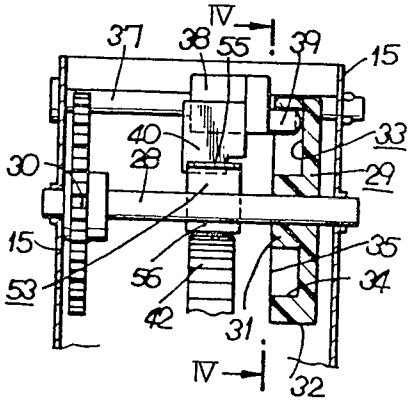
FIG. 3 is a sectional view taken along line III—III of FIG. 1.
Figure 4:
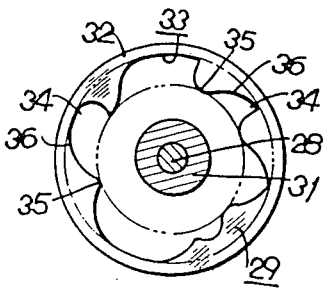
FIG. 4 is a sectional view taken along line IV—IV of FIG. 3.

In the drawings, reference numeral 1 represents a toy body, which assumes the shape of a pig consisting of a body frame 2, right and left foreleg frames 3, 3, right and left hind leg frames 4, 4, a tail frame 5 and a fluff cover 6 covering these frames. A guide hole 8 having a rectangular sectional shape which opens in a longitudinal direction is formed at the front part of a head frame 7 and a prismatic guide member 10 formed at the base end portion of a nose frame 9 is fitted retractilly into this guide hole 8. The right and left foreleg frames 3, 3 are fitted into insertion ports 11, 11 formed at the right and left front portions of the abdominal region of the body frame 2 in such a manner as to be capable of moving back and forth, while the right and left hind leg frames 4, 4 are fitted into insertion ports 12, 12 formed at the right and left rear portions of the abdominal region in such a manner as to be capable of moving back and forth. Furthermore, the tail frame 5 is fitted into a guide port 14 at the rear of a hip frame 13 of the body frame 2 in such a manner as to be capable of rotating in the horizontal surface.

Next, a machine frame 15 and a battery case 16 are fixed at the front and rear portions inside the body frame 2, and both end portions of a front support rod 17, which extends transversely at a front lower portion of the machine frame 15, are inserted rotatably into elongated guide grooves 19, 19 of fitting plates 18, 18 that project from the upper part of the foreleg frames 3, 3 fitted into the insertion ports 11, 11, respectively. Both end portions of a rear support rod 20, which extends transversely at a rear lower portion of the battery case 16, are inserted rotatably into insertion ports 22, 22 at the base portions of fitting plates 21, 21 that project from the upper portions of the hind leg frames 4, 4 inserted into the insertion ports 12, 12, respectively. A crank shaft 23 extends rotatably and transversely near the front lower end portion of the machine frame 15 and right and left crank arms 24, 24 of this crank shaft 23 are inserted rotatably into insertion ports 25, 25 at the base end portions of the fitting plates 18, 18 of the right and left foreleg frames 3, 3, respectively. The rear end portions of right and left interlocking plates 26, 26, whose front end portions are supported rotatably by the right and left crank arms 24, 24, are supported rotatably at the upper end portions of the fitting plates 21, 21 of the right and left hind leg frames 4, 4, respectively.

Next, a calling device 27 is disposed in the machine frame 15. In this calling device 27, a rotary shaft 28 is supported rotatably and transversely at the upper front portion of the machine frame 15 and a cam disc 29 is fixed to one of the ends of this rotary shaft 28 while an input gear 30 is fixed to the other end. A cam 33 for changing the sound is formed on the inner peripheral wall of an outer peripheral portion 32 with a center bearing 31 fixed to the rotary shaft 28 being the center. This cam 33 has a continuous shape consisting of irregular guide recesses 34 and guide projections 35 that repeat alternately through arc-shaped guide surface portions 36. A support shaft 37 extends transversely at the upper front portion of the machine frame 15 and the base end portion of a rocking arm 38 is supported by this support shaft 37 in such a manner as to be capable of rotating vertically. A rocking pin 39, constituting a cam follower means, meshes with the cam 33. The rocking pin 39 of the disc 29 and rocks as it follows the rotation of the cam 33 projects horizontally from the outside portion at the tip of the rocking arm 38 and a support plate 40 projects from the inner side portion at the tip of the rocking pin 39.

A rotary shaft 41 extends rotatably and transversely from the machine frame 15 below the rotary shaft 28 described already and a round saw-like calling gear 42 is fixed to one side portion of this rotary shaft 41, that is, at a position immediately below the support plate 40 of the rocking arm 38. Each tooth 43 formed around the periphery of this calling gear 42 has a varying pitch between it and adjacent teeth within a predetermined range so as to generate a pitch of the sound. In other words, there are disposed sequentially dense pitch portions 44 which generate a high-pitched tone, coarse pitch portions 45 which generate a low-pitched tone and intermediate pitch portions 46 which generate an intermediate pitch tone, within a predetermined range. A relay gear 48 having an output gear 47 which meshes with the input gear 30 is fixed to the other side portion of the rotary shaft 41. A resonance box 49 whose lower surface portion is open is fixed to the upper part of the machine frame 15 and the peripheral portion 52 of a resonance plate 51 is fitted into an anchor groove 50 around the periphery of the opening on the lower surface of the resonance box 49. An intermediate portion of a resonance lead 53 consisting of a leaf spring is fixed by a rivet 54 to the intermediate portion of the resonance plate 51. An engaging portion 55 which biases upward and engages the lower end portion of the support plate 40 is formed at the tip of the resonance lead 53. An oscillation portion 56 is formed at the lower end of the engaging portion 55 and engages with, and disengages from, each tooth 43 of the calling gear 42. An anchor portion 57 at the rear end portion of the resonance lead 53 is fitted and anchored to an anchor hole 58 which is formed around the open edge of the resonance box 49. This resonance lead 53 always biases the rocking pin 39 of the rocking arm 38 and lets it mesh with the cam 33 described already.

A motor 59 is fixed at the rear portion of the machine frame 15 and is connected electrically to a battery inside the battery case 16 through a switch 60, which is disposed on a lid 61 of the battery case 16 which can be opened and closed. A power change-over mechanism 64 is connected to a pinion 62 of the motor 59 in the interlocking arrangement therewith through a gear interlocking mechanism 63.

In this power change-over mechanism 64, a transversely elongated driving gear 66 is supported rotatably by the machine frame 15 through a rotary shaft 65 which is rotated by the gear interlocking arrangement mechanism 63, and first and second interlocking gears 67 and 68 which mesh with the driving gear 66 described above as a common driving source are also supported rotatably by the machine frame 15 through a slide shaft 69. The first interlocking gear 67 is fixed to the slide shaft 69 while the second interlocking gear 68 is supported rotatably and slidably in an axial direction of the slide shaft 69. An elongated change-over groove 71 which engages with and disengages from a change-over pawl 70 of the first interlocking gear 67 upon rotation is formed in an arcuate form at the outer side portion with respect to the center of the second interlocking gear 68, and these first and second interlocking gears 67 and 68 have the numbers of teeth which are slightly different from each other. A change-over gear 72 is supported rotatably and slidably in the axial direction of the slide shaft 69 at the outer side portion of the second interlocking gear 68. The change-over gear 72 and the second interlocking gear 68 are connected and anchored integrally with each other through respective bearing bosses 73, and a coil spring 74 is wound on the slide shaft 69 between the change-over gear 72 and the machine frame 15 in order to normally urge the change-over gear 72 and the second interlocking gear 68 towards the first interlocking gear 67.

A first driving gear 76 which has a relay gear 75 substantially below the intermediate part of the machine frame 15 and is capable of engaging with and disengaging from the change-over gear 72 is supported rotatably by a rotary shaft 77 and the relay gear 75 of this first driving gear 76 meshes with a leg operation gear 78 fixed to the crank shaft 23. Another crank shaft 79 is supported rotatably at an almost intermediate upper portion of the machine frame 15. An interlocking gear 80 meshing with the relay gear 48 of the calling device 27 and a second driving gear 81 meshing removably with the change-over gear 72 are fixed to one side portion of the crank shaft 79. The base end portions of a front operation plate 83 and rear operation plate 84 are supported rotatably by a crank arm 82 at one of the end portion of the crank shaft 79, and a projection 85 of the guide member 10 of the nose frame 9 is connected to the tip of the front operation plate 83 through a shaft 86. One of the end portions of a bell crank 87 is supported rotatably at the tip of the rear operation plate 84 and this bell crank 87 is fitted rotatably in the horizontal direction by a fitting frame 88 at the upper rear end portion of the battery case 16 through a shaft 89. A pin 93 of a projection 92, which projects from a rotary member 91 at the base end portion of the tail frame 5, is fitted into an elongated groove 90 at the other end portion of the bell crank 87, and this rotary member 91 is fitted rotatably in the horizontal direction to the fitting frame 88 through a support shaft 94.

Next, the operation of the construction described above will be explained.

When the switch 60 is closed, the motor 59 starts its operation and the driving gear 66 of the power change-over mechanism 64 is rotated through the pinion 62 and the gear interlocking mechanism 63. The rotation of this driving gear 66 rotates the first and second interlocking gears 67 and 68. In this case, however, if rotation is effected while the change-over pawl 70 of the first interlocking gear 67 is inserted into the elongated change-over groove 71 of the second interlocking gear 68, that is, while the second interlocking gear 68 is close to the first interlocking gear 67, the change-over gear 72 which is biased by the coil spring 74 meshes with the first driving gear 76 and the first driving gear 76 is rotated. Therefore, the relay gear 75 which is integral with the first driving gear 76 rotates the leg operation gear 78 and the crank shaft 23 is rotated. Due to the rotation of the crank arms 24, 24 at both end portions of this crank shaft 23, the right and left foreleg frames 3, 3 are rotated back and forth with both end portions of the front support rod 17 being the center, respectively. Due to the rotation of the right and left foreleg frames 3, 3, the right and left interlocking plates 26, 26 are moved back and forth and in turn rotate back and forth the right and left hind leg frames 4, 4 with both end portions of the rear support rod 20 being the center, respectively. Therefore, if rotation is effected while the second interlocking gear 68 is close to the first interlocking gear 67, the toy body 1 repeats its advance action for a predetermined period by rotation of the right and left foreleg frames 3, 3 and hind leg frames 4, 4 in the longitudinal direction.

The rotation of the driving gear 66 further rotates the first and second interlocking gears 67 and 68. Since the numbers of teeth of these gears are different, the change-over pawl 70 of the first interlocking gear 67 escapes gradually from the elongated change-over groove 71 of the second interlocking gear 68 while this change-over pawl 70 pushes gradually the second interlocking gear 68 and the change-over gear 72 in the axial direction against the force of the coil spring 74. Then, the tip of this change-over pawl 70 comes off from the elongated change-over groove 71, contacts with the side surface of the second interlocking gear 68 while sliding thereon, whereupon the change-over gear 72, which is pushed in the axial direction by the second interlocking gear 68 against the force of the coil spring 74, comes off from the first driving gear 76, meshes with the second driving gear 81 in place of the first driving gear 76 and rotates the second driving gear 81. Therefore, the leg operation gear 78 is not rotated any longer and the toy body 1 stops its advance.

When the second driving gear 81 is rotated by the change-over gear 72, the crank shaft 79 is rotated and the rotation of its crank arm 82 moves back and forth the front operation plate 83 and the rear operation plate 84.

The guide member 10 is moved back and forth inside the guide hole 8 by the movement of the front operation plate 83 through the projection 85 and the shaft 86, and consequently, the nose frame 9 is moved back and forth as the toy body 1 twitches the nose.

When the rear operation plate 84 moves back and forth, the rotary member 91 is moved in the horizontal direction with the support shaft 94 being the center through the bell crank 87, the projection 92 and the pin 93, so that the tail frame 5 is rotated in the horizontal surface as the toy body 1 wags its tail as if to drive away any horseflies or flies.

Figure 1:
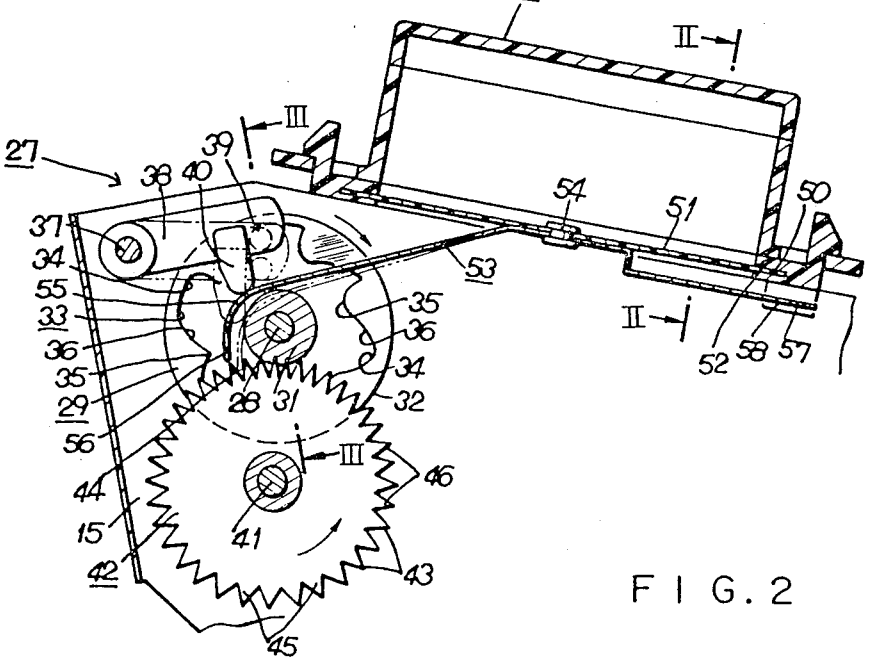
FIG. 1 is a sectional view of a calling device.
Figure 2:
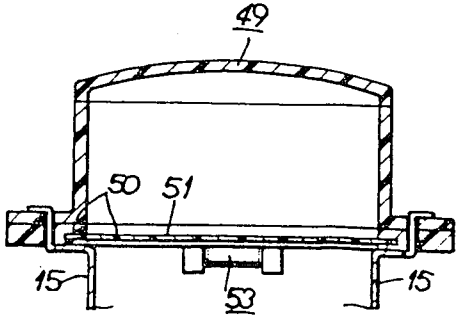
FIG. 2 is a sectional view taken along line II—II of FIG. 1.
Figure 5:
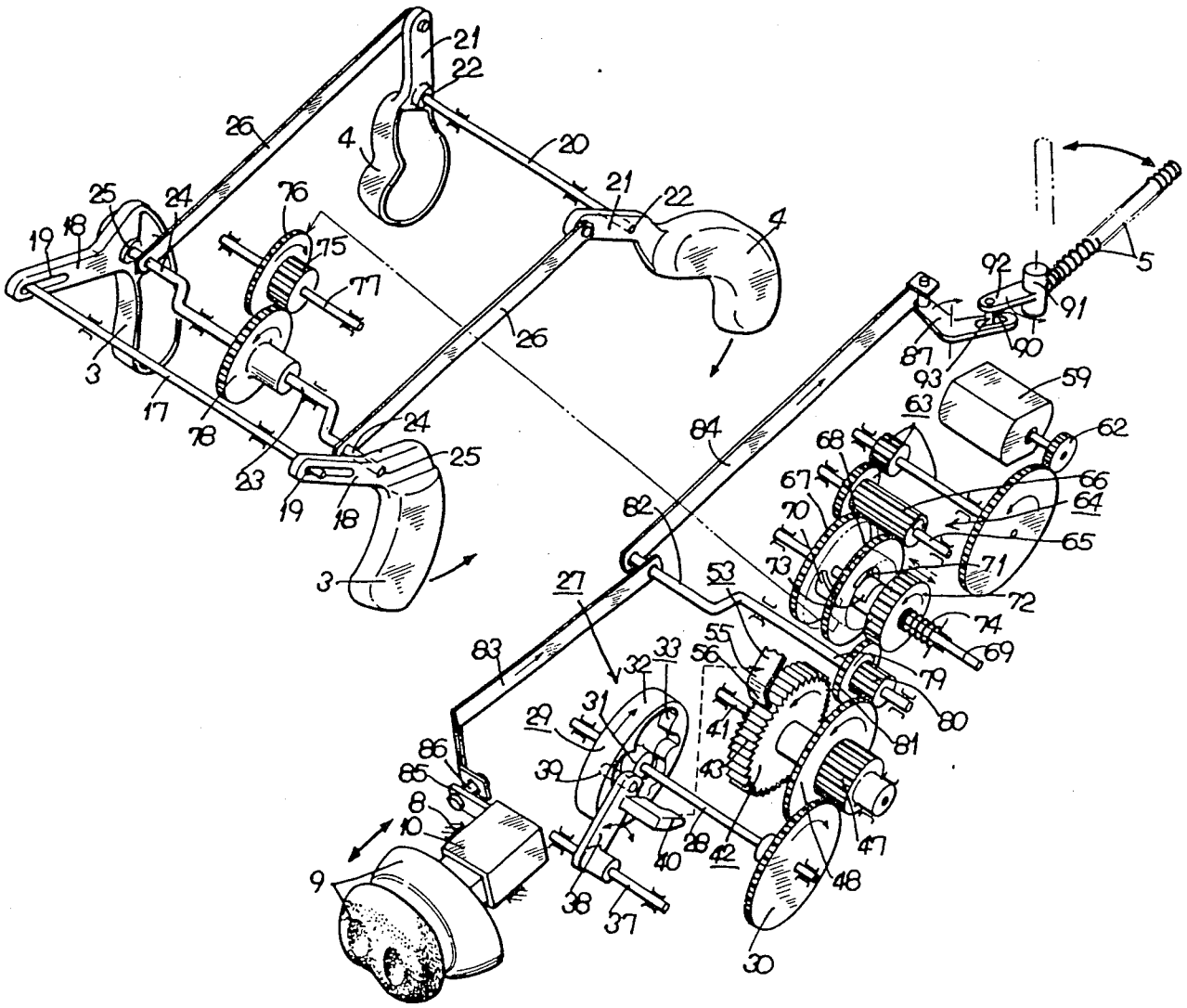
FIG. 5 is an exploded perspective view of a motion toy.
Figure 6:
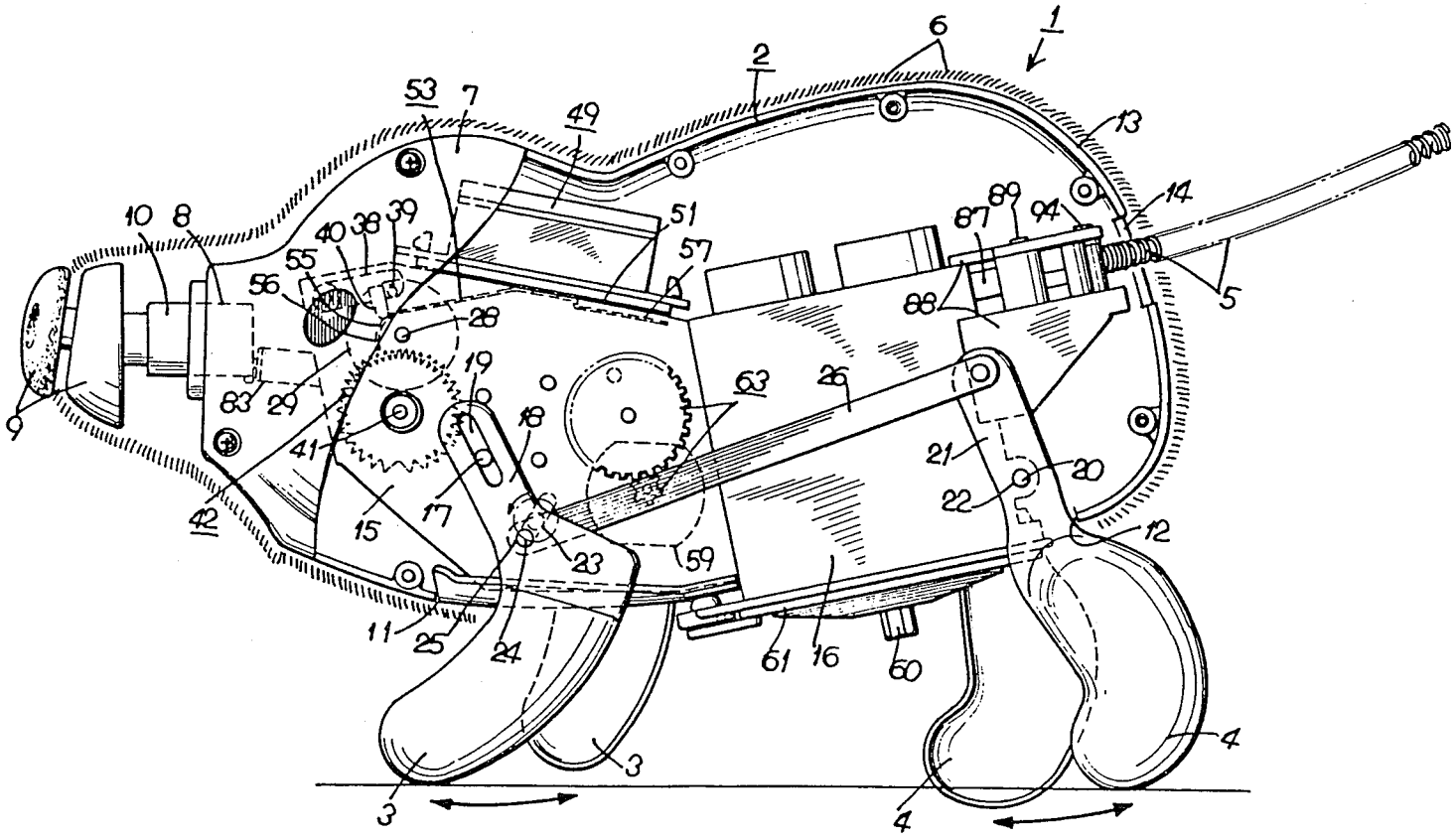
FIG. 6 is a side view on one side of the motion toy under its assembled state.
Figure 7:
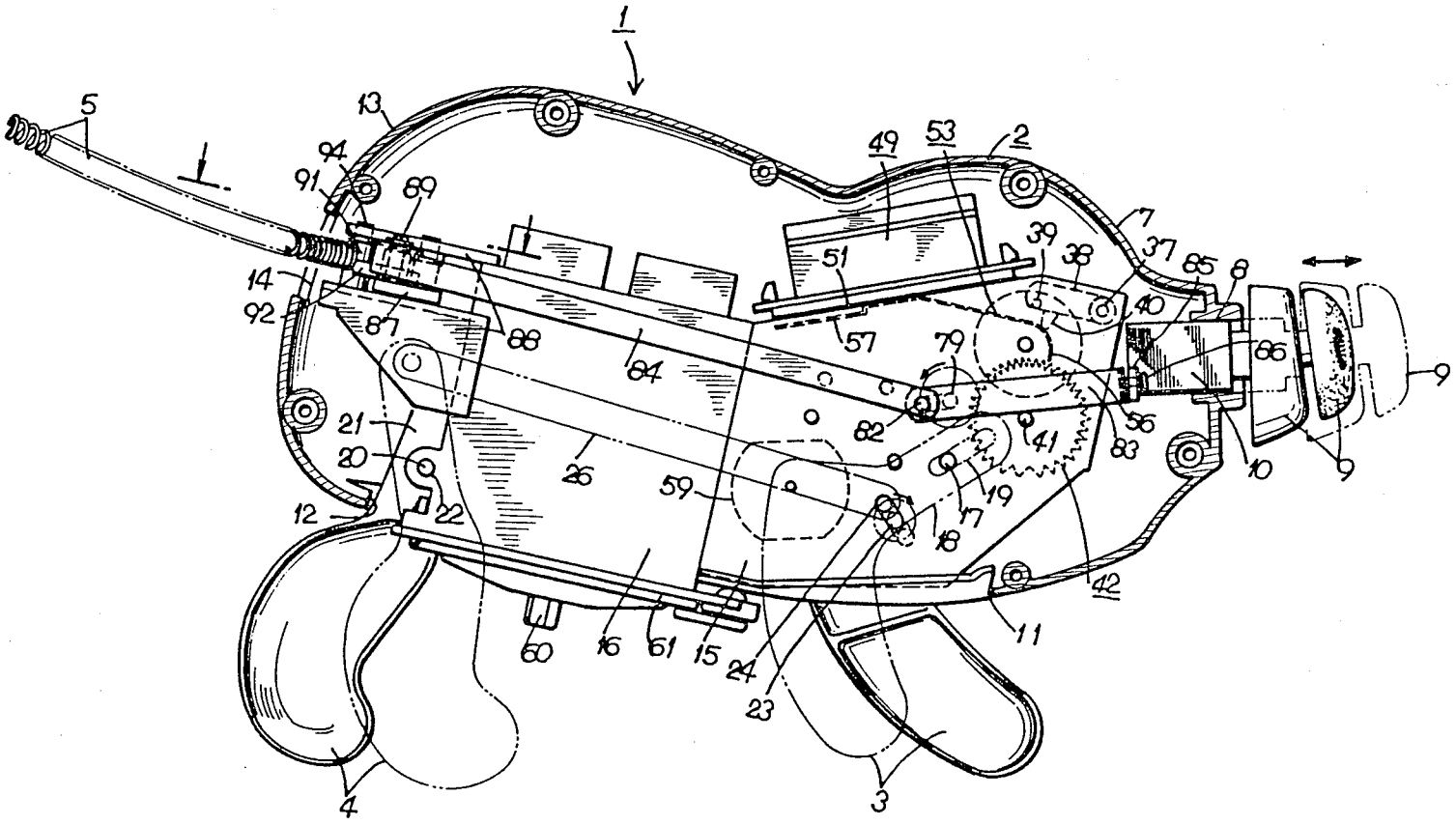
FIG. 7 is a side view on the other side of the motion toy.
Figure 8:
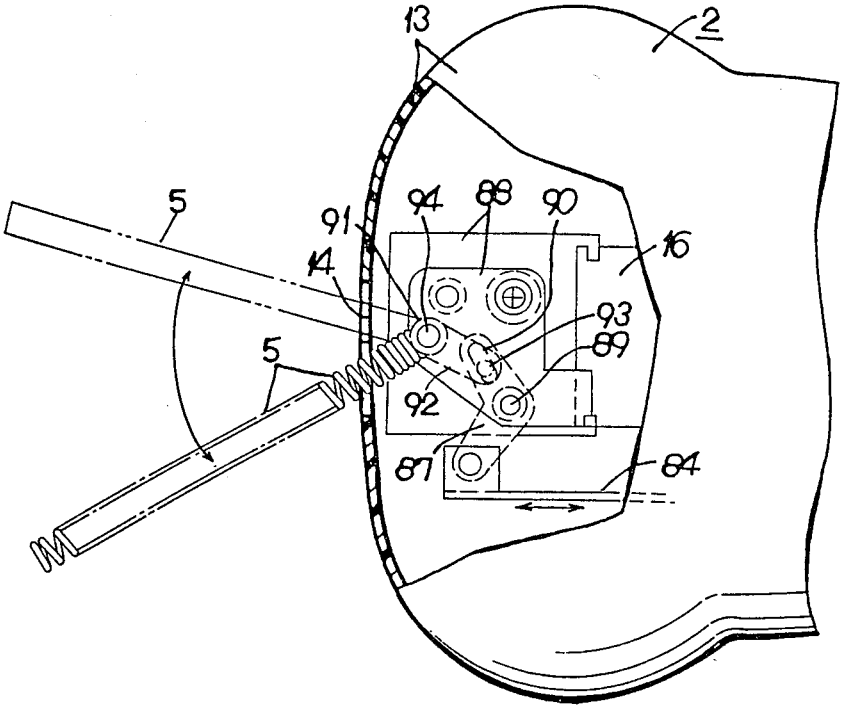
FIG. 8 is a partial cut-away plan view of the tail portion of the motion toy.
Figure 9:
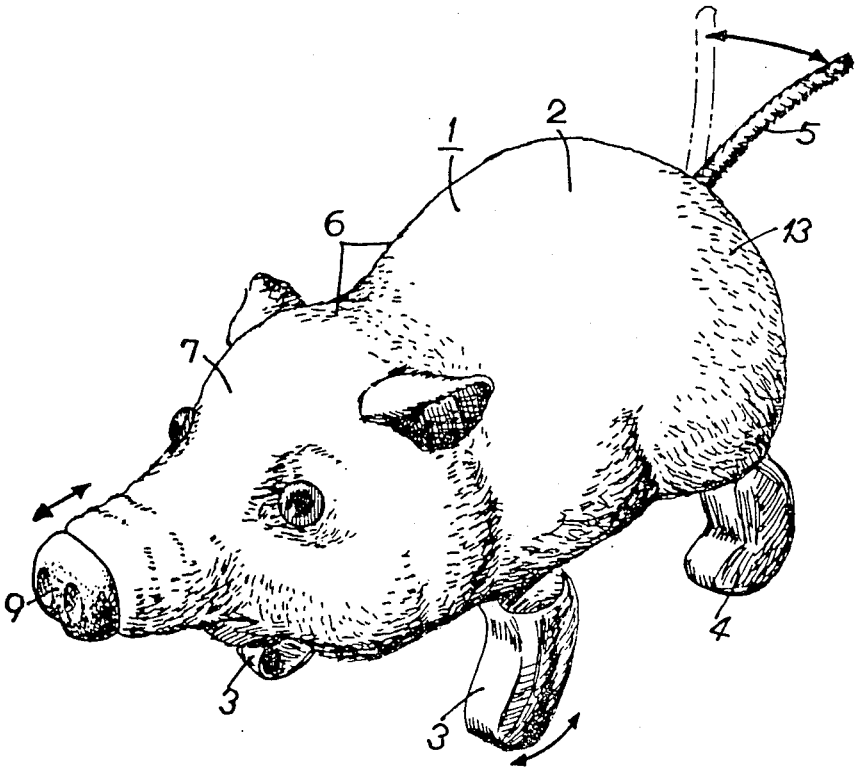
FIG. 9 is a perspective view of the motion toy.

When the second driving gear 81 is rotated as described above, the calling gear 42 is rotated counterclockwise in FIG. 1 through the interlocking gear 80 and the relay gear 48, and the rotation of the relay gear 48 rotates the cam disk 29 clockwise in FIG. 1 through the output gear 47 and the input gear 30.

Due to the rotation of the cam disk 29, the rocking pin 39 meshing with this cam 33 is rocked up and down in accordance with the shape of the cam 33 and the rocking arm 38 having this rocking pin 39 is rocked up and down with the support shaft 37 being the center. Due to the rocking operation of this rocking arm 38, the support plate 40 is rocked vertically and the resonance lead 53 meshing its engaging portion 55 with the lower end portion of the support plate 40 is moved up and down and the oscillation portion 56 of the resonance lead 53 is engaged sequentially and interruptedly with and disengaged from each tooth 43 of the calling gear 42 that is rotated. Due to the lowering motion of the oscillation portion 56 which is moved up and down and to the sliding rotation of each tooth 43 of the calling gear 42, a sound of sliding rotation having a predetermined amplitude is generated and this sliding rotation sound is amplified inside the resonance box 49 through the resonance lead 53 and the resonance plate 51 and causes great resonance. In other words, if the rocking pin 39 of the rocking arm 38 meshes with the guide recess 34 due to the rotation of the cam disk 29 at its cam 33, the oscillation portion 56 of the resonance lead 53 is not pushed by the support plate 40 so that this oscillation portion 56 does not mesh with each tooth 43 of the calling gear 42. If the rocking pin 39 meshes with the guide projection 35 from the guide surface portion 36, the engaging portion 55 of the resonance lead 53 is gradually pushed downward by the support plate 40 and the oscillation portion 56 meshes interruptedly with each tooth 43 at a predetermined position of the rotating calling gear 42. As the cam disk 29 is further rotated, the rocking pin 39 meshes with the highest position of the guide projection 35, whereupon the engaging portion 55 of the resonance lead 53 is pushed further downward by the support plate 40 and the oscillation portion 56 is engaged with the valley portion of each tooth 43 at a predetermined position of the rotating calling gear 42.

Since the rocking pin 39 meshes sequentially with the guide projection 35 from the guide recess 34 at each portion of the cam 33 through the guide surface portion 36 in the manner described above, the oscillation portion 56 of the resonance lead 53 whose engaging portion 55 is engaged with and supported by the support plate 40 sequentially engages with and disengages from each tooth 43 of the calling gear 42 in a predetermined amplitude. In this case, if the oscillation portion 56 of the resonance lead 53 engages and disengages at the dense pitch portion of each tooth 43, the sliding rotation sound between this oscillation portion 56 and the dense pitch portion 44 becomes a relatively high-pitched sound and this high-pitched sound is amplified and resonates inside the resonance box 49. If the oscillation portion 56 of the resonance lead 53 engages and disengages at the coarse pitch portion 45 of each tooth 43, the sliding rotation sound of the oscillation portion 56 and the coarse pitch portion 45 becomes a relatively low-pitched sound and this low-pitched sound is amplified and resonates inside the resonance box 49.

Accordingly, the toy body 1 generates an imitation sound like the grunting sound of the pig.

Thereafter, the toy body 1 stops its advance, wags the tail to the right and left, moves its nose and generates the grunting sound repeatedly for a predetermined period.

Next, the driving gear 66 further rotates the first and second interlocking gear 67 and 68 and when the change-over pawl 70 of the first interlocking gear 67 is in agreement with the elongated change-over groove 71 of the second interlocking gear 68, the change-over gear 72 and the second interlocking gear 68 are moved in the axial direction towards the first interlocking gear 67 by the returning action of the coil spring 74, the change-over pawl 70 of the first interlocking gear 67 is inserted into the elongated change-over groove 71 of the second interlocking gear 68 and the first and second interlocking gears 67, 68 are rotated close to each other. Due to the rotation of these gears while they are close to each other, the change-over gear 72 that has been pushed by the coil spring 74 disengages from the second driving gear 81 and meshes with the first driving gear 76. When the change-over gear 72 thus comes off from the second driving gear 81, the toy body 1 stops its wagging and grunting operations and since the change-over gear 72 meshes with the first driving gear 76, the toy body 1 resumes its advancing operation as described already.

The present invention provides the following effects.

In accordance with the present invention, the calling sound of the motion toy can be generated easily and reliably through the engagement of the oscillation portion of the resonance lead of the resonance box with each tooth of the calling gear. The calling sound thus generated can be resonated greatly inside the resonance box. Since the operation of the oscillation portion of the resonance lead of the resonance box can be controlled by the cam, the calling sound can be changed reliably so that the present invention will be most suitable as the calling device of motion toys generating calling sounds.

In accordance with the present invention, further, the calling device described above is applied to the motion toy which exhibits changeably the advancing operation, the moving operation of the nose frame and the horizontal rotation operation of the tail frame. Therefore, the toy body 1 moves back and forth the nose frame in response to the calling sound generated from the calling device at the stop of the advancing operation of the toy body and exhibits the motion as if a pig moved his nose and grunted. Since the tail frame is rotated horizontally at this time, the toy body exhibits the motion as if the pig drove away any flies and grunted while wagging his nose. Therefore, the present invention can provide a motion toy which is extremely exciting and interesting and has high amusing properties.

What is claimed is:

1. A calling device of a motion toy comprising:

a machine frame;

a calling gear having teeth thereon rotatably mounted on said machine frame;

a resonance box mounted on said machine frame and having a resonance lead equipped with an oscillation portion facing said calling gear;

rocking arm rotatably mounted on said machine frame and having a support plate engageable with said resonance lead, and a cam follower means; and a cam rotatably mounted on said machine frame for contact with said cam follower means, rotation of said cam causing said cam follower means to rotate said rocking arm back and forth and move said associated support plate into engagement with said disengagement from said oscillation portion of said resonance lead thereby causing said resonance lead to intermittingly contact said teeth on said calling gear.

2. A calling device according to claim 1 wherein said cam follower means comprises a rocking pin mounted at the tip of said rocking arm for contact with said rotatable cam.

3. A motion toy comprising:

a toy body having a machine frame disposed inside a body frame, right and left foreleg frames and hind leg frames disposed rotatably in said body frame, and nose frame disposed movably back and forth in said body frame and a tail frame disposed rotatably in a horizontal surface in said body frame;

a first driving gear disposed rotatably in said machine frame of said toy body for rotating said right and left foreleg frames and hind leg frames back and forth through a crank shaft;

a second driving gear disposed rotatably in said machine frame for operating said noise frame and said tail frame through a crank shaft;

a calling gear having teeth thereon rotatably mounted on said machine frame and rotated by the power from said second driving gear;

a resonance box mounted on said machine frame and having a resonance lead equipped with an oscillation portion facing said calling gear;

a rocking arm rotatably mounted on said machine frame and having a support plate engageable with said resonance lead, and a cam follower means;

a cam rotatably mounted on said machine frame for contact with said cam follower means, rotation of said cam causing said cam follower means to rotate said rocking arm back and forth and move said associated support plate into engagement with and disengagement from said oscillation portion of said resonance lead thereby causing said resonance lead to intermittingly contact said teeth on said calling gear;

a changeover gear mounted on said machine frame for rotational movement about an axis and slidable movement along said axis is alternatively place said changeover gear in driving engagement with either said first driving gear or said second driving gear; and a motor operatively connected to drive said changeover gear.

4. A motion toy according to claim 3 wherein said cam follower means comprises a rocking pin mounted at the tip of said rocking arm for contact with said rotatable cam.

* * * * *